US008071178B2

(12) United States Patent
Nakajima et al.

(10) Patent No.: US 8,071,178 B2
(45) Date of Patent: Dec. 6, 2011

(54) METHOD OF FORMING METAL FILM AND METAL WIRING PATTERN, UNDERCOAT COMPOSITION FOR FORMING METAL FILM AND METAL WIRING PATTERN, AND METAL FILM

(75) Inventors: Seiji Nakajima, Kyoto (JP); Tetsuya Mori, Kyoto (JP); Hidemi Nawafune, Takatsuki (JP)

(73) Assignee: OMRON Corporation, Kyoto (JP)

( * ) Notice: Subject to any disclaimer, the term of this patent is extended or adjusted under 35 U.S.C. 154(b) by 1019 days.

(21) Appl. No.: 11/917,133

(22) PCT Filed: Jun. 6, 2006

(86) PCT No.: PCT/JP2006/311322

§ 371 (c)(1),
(2), (4) Date: Dec. 10, 2007

(87) PCT Pub. No.: WO2006/132241

PCT Pub. Date: Dec. 14, 2006

(65) Prior Publication Data

US 2010/0215979 A1 Aug. 26, 2010

(30) Foreign Application Priority Data

Jun. 9, 2005 (JP) ..... 2005-169643

(51) Int. Cl.
*C08F 2/48* (2006.01)
*C08F 2/50* (2006.01)

(52) U.S. Cl. ..... 427/508; 427/510; 427/512; 427/517

(58) Field of Classification Search ..... 427/508, 427/510, 512, 517
See application file for complete search history.

(56) References Cited

U.S. PATENT DOCUMENTS

| | | | | |
|---|---|---|---|---|
| 3,523,824 | A * | 8/1970 | Powers et al. | 427/131 |
| 3,900,320 | A * | 8/1975 | Rolker et al. | 430/324 |
| 4,307,211 | A * | 12/1981 | Ito et al. | 525/383 |
| 4,943,482 | A | 7/1990 | Charmot et al. | |
| 5,200,272 | A | 4/1993 | Sirinyan et al. | |

FOREIGN PATENT DOCUMENTS

| | | | |
|---|---|---|---|
| JP | 10-18044 | | 1/1989 |
| JP | 1-195284 | | 8/1989 |
| JP | 1-312080 | | 12/1989 |
| JP | 06075111 | A * | 3/1994 |
| JP | 10-317153 | | 12/1998 |
| JP | 11-284314 | | 10/1999 |
| JP | 2001-73159 | | 3/2001 |

OTHER PUBLICATIONS

Notification of Transmittal of Translation of the International Preliminary Report on Patentability (Chapter I or Chapter II of the Patent Cooperation Treaty) for International Application No. PCT/JP2006/311322 (4 pages).
English translation of Office Action in Chinese Patent Application No. 200680020597X, mailed Sep. 25, 2009 (10 pages).
Mechanical English translation of JP 2001-073159, published Mar. 21, 2001 (7 pages).
Mechanical English translation of JP 10-317153, published Dec. 2, 1998 (12 pages).
English translation of the Second Office Action for Chinese Application No. 200680020597.X issued on May 5, 2010, 12 pages.
Office Action for Japanese Application No. 2007-520122 mailed on Jun. 15, 2010 and English translation thereof, 4 pages.
International Search Report (English only) PCT/JP2006/311322 mailed Sep. 5, 2006 (2 pages).
Patent Abstracts of Japan 2001-073159 dated Mar. 21, 2001 (1 page).
Patent Abstracts of Japan 10-317153 dated Dec. 2, 1998 (1 page).
Patent Abstracts of Japan 01-195284 dated Aug. 7, 1989 (1 page).
Patent Abstracts of Japan 11-284314 dated Oct. 15, 1999 (1 page).
Patent Abstracts of Japan 10-018044 dated Jan. 20, 1998 (1 page).
Patent Abstracts of Japan 01-312080 dated Dec. 15, 1989 (1 page).
Office Action for Chinese Patetn Application No. 200680020597.x, Issued on Aug. 3, 2011 (20 pages with English Translation).

* cited by examiner

*Primary Examiner* — Elena T Lightfoot
(74) *Attorney, Agent, or Firm* — Osha • Liang LLP

(57) ABSTRACT

A method of forming a metal film and a metal wiring pattern is described a step of forming an organic film by applying and polymerizing an undercoat composition for forming a metal film containing an addition-polymerizable monomer having an acidic group and a polymerization initiator on a substrate or film, a step of converting the acidic group into a metal (M1) salt by treating the organic film with an aqueous solution containing a metal (M1) ion, a step of converting the metal (M1) salt into a metal (M2) salt by treating the organic film with an aqueous solution containing a metal (M2) ion having an ionization tendency lower than the metal (M1) ion, and a step of forming a metal film on the organic film surface by reducing the metal (M2) ion.

28 Claims, No Drawings

METHOD OF FORMING METAL FILM AND METAL WIRING PATTERN, UNDERCOAT COMPOSITION FOR FORMING METAL FILM AND METAL WIRING PATTERN, AND METAL FILM

TECHNICAL FIELD

The present invention relates to a method of forming a metal film and a metal pattern on any substrate or film, an undercoat composition for forming a metal film used in the method above, and a metal film formed by the method.

BACKGROUND ART

Known methods of forming a metal film include so-called dry processes such as vapor deposition, sputtering, and ion plating, so-called wet processes such as electroplating and electroless plating, and the like, but the dry processes demand large facility cost, while it was difficult to prepare a metal film having a thickness of several dozen nm by such a wet process.

Thus reported is a method of forming a metal film by generating a cation-exchange group by modification of a polyimide resin, binding a metal ion to the cation-exchange group, and reducing the metal (Patent Document 1). However, such a method forms a film by modification of polyimide and does not allow use of other substrates. A method of obtaining a hardened film after application of polyimide varnish on a substrate may be possible, but it demands baking at high temperature (e.g., at 200° C. or higher) for hardening and does not allow use of a substrate lower in heat resistance because of deformation (less general-purpose properties). In addition, the polyimide resins are rather expensive. Common polyimide resins (e.g., Kapton and Upilex) are also less transparent to light in the UV light range, and transparent polyimide resins are resistant to modification. When an electric circuit is formed, for example, in a metal pattern formed through a mask by the methods above, the low transmittance to UV light, which leads to deterioration in resolution, is not suitable for fine wiring. Further, use of a heated high-concentration alkaline solution, for example at dozens of temperature, causes a problem of safety.

Patent Document 1: Japanese Unexamined Patent Publication No. 2001-73159

DISCLOSURE OF INVENTION

Technical Problems to be Solved

An object of the present invention is to provide a method of forming a metal film and a metal wiring pattern on any substrate or film at low cost, even if it is a relatively thin metal film or metal pattern, and an undercoat composition for forming the metal film and the metal wiring pattern.

Another object of the present invention is to provide a method of forming a metal film on any substrate or film at low cost, even if it is a relatively thin and complicated metal pattern, and an undercoat composition for forming the metal film.

Yet another object of the present invention is to provide a metal film and a metal wiring pattern that can be formed on any substrate or film at low cost.

Means to Solve the Problems

The present invention relates to a method of forming a metal film, comprising:

a step of forming an organic film by applying and polymerizing an undercoat composition for forming a metal film containing an addition-polymerizable monomer having an acidic group or ester group thereof and a polymerization initiator on a substrate or film;

a step of converting the acidic group or ester group thereof into a metal (M1) salt by a particular processing;

a step of converting the metal (M1) salt into a metal (M2) salt by treating the organic film with an aqueous solution containing the metal (M2) ion having an ionization tendency lower than the metal (M1) ion; and a step of forming a metal film on the organic film surface by reducing the metal (M2) ion.

Thus, the present invention relates to a method of forming a metal film, comprising:

a step of forming an organic film by applying and polymerizing an undercoat composition for forming a metal film containing an addition-polymerizable monomer having an acidic group and a polymerization initiator on a substrate or film (step (A));

a step of converting the acidic group to a metal (M1) salt by treating the organic film with an aqueous solution containing the metal (M1) ion (step (B), in particular step (b1));

a step of converting the metal (M1) salt to a metal (M2) salt by treating the organic film with an aqueous solution containing the metal (M2) ion having an ionization tendency lower than that of the metal (M1) ion (step (C)); and a step of forming a metal film on the organic film surface by reducing the metal (M2) ion (step (D)).

The present invention also relates to a method of forming a metal film and a metal wiring pattern, comprising:

a step of forming an organic film by applying and polymerizing an undercoat composition for forming a metal film containing an addition-polymerizable monomer having the ester group of an acidic group and a polymerization initiator on a substrate or film (step (A));

a step of converting the ester group of the acidic group to an alkali-metal salt of the acidic group by treating the organic film with an aqueous solution containing the metal (M1) ion (step (B), in particular treatment (b2-1));

a step of converting the alkali-metal salt of the acidic group to a metal (M2) salt by treating the organic film with an aqueous solution containing the metal (M2) ion having an ionization tendency lower than that of the alkali metal ion (step (C)); and a step of forming a metal film on the organic film surface by reducing the metal (M2) ion (step (D)).

The present invention also relates to a method of forming a metal film, comprising:

a step of forming an organic film by applying and polymerizing an undercoat composition for forming a metal film containing an addition-polymerizable monomer having the ester group of an acidic group and a polymerization initiator on a substrate or film (step (A));

a step of converting the ester group of the acidic group into an metal (M1) salt of the acidic group by treating the organic film with an aqueous acid solution and then with an aqueous solution containing the metal (M1) ion, (step (B), in particular treatment (b2-2));

a step of converting the metal (M1) salt to a metal (M2) salt by treating the organic film with an aqueous solution containing the metal (M2) ion having an ionization tendency lower than the metal (M1) ion (step (C)); and a step of forming a metal film on the organic film surface by reducing the metal (M2) ion (step (D)).

The present invention also relates to an undercoat composition for forming a metal film for use in any one of the methods of forming a metal film above.

The present invention also relates to a metal film and a metal wiring pattern formed by any one of the methods of forming a metal film above.

EFFECTS OF THE INVENTION

According to the present invention, it is possible to form a relatively thin metal film or metal pattern on any substrate or film, because the organic film is formed without high temperature baking by applying and polymerizing an undercoat composition for forming a metal film containing a specific addition-polymerizable monomer and a polymerization initiator on a substrate or film. For example, it is possible to use a substrate or film of a cheaper low-heat resistance resin (such as acrylic resin, polycarbonate, polyethylene terephthalate, or epoxy resin). It is also possible to reduce facility cost, and thus, production cost as well.

In particular, as the undercoat composition for forming a metal film used in the present invention is superior in transparency and remains so even after polymerization, resolution is improved compared to the conventional technique, and thus, it is possible to form even a fine metal pattern, by carrying out reduction by ultraviolet ray irradiation through a mask in the metal film-forming step.

It is also possible to perform three-dimensional patterning easily, by removing unreacted monomers after polymerization with ultraviolet ray irradiation through a mask in the organic film-forming step. In such a case, it is possible to shorten the total processing period of fine wiring plating to ⅓, compared to that by the conventional methods, because there is no need for UV irradiation for reduction in the metal film-forming step.

BEST MODE FOR CARRYING OUT THE INVENTION

The method of forming a metal film according to the present invention is characterized by having at least the steps (A) to (D) shown below.

Step (A);

In the step (A), an undercoat composition for forming a metal film is prepared, and an organic film is formed by applying and polymerizing the composition on a substrate or film. The undercoat composition for forming a metal film, which is aimed at forming an underground film (resin film) for forming a particular metal film by precipitation of the metal (M2) ion introduced in the step (C) described below on the surface, contains in particular an addition-polymerizable monomer having an acidic group or the ester thereof and a polymerization initiator. Hereinafter, the addition-polymerizable monomer having an acidic group or the ester thereof will be referred to simply as a "monomer 1".

The acidic group of the monomer 1 is not particularly limited, when it can retain the metal ion for preparation of metal film in the salt form, and examples thereof include carboxyl, sulfonic acid, hydroxyl groups, and the like. Such an acidic group may be present in the ester form, and thus, the monomer 1 may an ester of the acidic group. The group for such an ester group is not particularly limited, when the ester bond is hydrolyzed in the step (b2) described below, and examples thereof include straight-chain or branched alkyl groups such as methyl, ethyl, n-propyl, isopropyl, n-butyl, isobutyl, sec-butyl and t-butyl; monovalent aromatic hydrocarbon groups such as phenyl; monovalent alicyclic hydrocarbon groups such as isobony and adamantyl; straight-chain or branched perfluoroalkyl group such as perfluoromethyl, perfluoroethyl, perfluoro-n-propyl, perfluoroisopropyl, perfluoro-n-butyl, perfluoroisobutyl, perfluoro-sec-butyl and perfluoro-t-butyl; ether groups such as ethyleneoxide and propyleneoxide; and the like.

The number of the acidic groups or the ester groups thereof on the monomer 1 is not particularly limited.

The monomer 1 has at least one polymerizable unsaturated bond, in particular one polymerizable double bond, in one molecule, and the number thereof is not particularly limited.

Examples of the monomer 1 include the compound represented by the following General Formulae (1a) to (8a).

(1a)

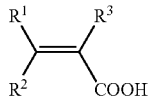

(2a)

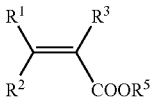

(3a)

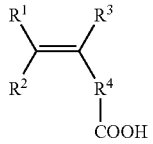

(4a)

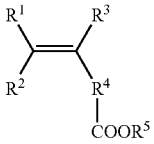

(5a)

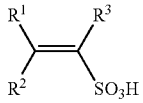

(6a)

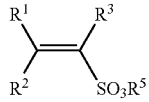

(7a)

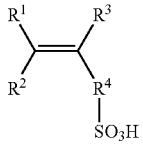

(8a)

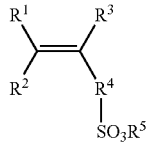

In Formulae (1a) to (8a), $R^1$ and $R^2$ each independently represent a hydrogen atom or an alkyl group having 1 to 3 carbon atoms, preferably a hydrogen atom at the same time. Typical examples of the alkyl groups include methyl, ethyl, n-propyl, and isopropyl.

$R^3$ represents a hydrogen atom or a methyl group.

$R^4$ represents a bivalent saturated aliphatic or aromatic hydrocarbon group. The bivalent saturated aliphatic hydrocarbon group preferably has 1 to 3 carbon atoms, and typical examples thereof include methylene, ethylene, dimethylene, propylene, trimethylene and the like. The bivalent aromatic hydrocarbon group is preferably a phenylene group. $R^4$ preferably represents a methylene or phenylene group.

$R^5$ is a group similar to that for the ester group of the acidic group, and examples thereof include the straight-chain or branched alkyl groups, the monovalent aromatic hydrocarbon groups, the monovalent alicyclic hydrocarbon groups, and the straight-chain or branched perfluoroalkyl groups described above, as well as ether groups such as ethyleneoxide and propyleneoxide. Favorable examples of $R^5$ include straight-chain or branched alkyl groups, in particular those such as methyl, ethyl, n-propyl, isopropyl, n-butyl, isobutyl, sec-butyl and t-butyl.

Typical examples of the compounds represented by General Formula (1a) include (meth)acrylic acid and the like. In the present description, (meth)acrylic acid means both acrylic acid and methacrylic acid, and for example, t-butyl (meth) acrylate means both t-butyl acrylate and t-butyl methacrylate.

Typical examples of the compounds represented by General Formula (2a) include methyl (meth)acrylate, ethyl (meth) acrylate, n-propyl (meth)acrylate, isopropyl (meth)acrylate, n-butyl (meth)acrylate, isobutyl (meth)acrylate, sec-butyl (meth)acrylate, t-butyl(meth)acrylate, and the like.

Typical examples of the compounds represented by General Formula (3a) include vinylbenzenecarboxylic acid, vinylacetic acid, and the like.

Typical examples of the compounds represented by General Formula (4a) include methyl vinylbenzenecarboxylate, t-butyl vinylbenzenecarboxylate, methyl vinylacetate, t-butyl vinylacetate and the like.

Typical examples of the compounds represented by General Formula (5a) include vinylsulfonic acid and the like. Typical examples of the compounds represented by General Formula (6a) include methyl vinylsulfonate, t-butyl vinylsulfonate and the like.

Typical examples of the compounds represented by General Formula (7a) include vinylbenzenesulfonic acid and the like.

Typical examples of the compounds represented by General Formula (8a) include methyl vinylbenzenesulfonate, t-butyl vinylbenzenesulfonate and the like.

Typical examples of monomer 1 other than the typical examples above include maleic acid, fumaric acid and the like.

Two or more monomers 1 may be used in combination in the present invention, and the number of the monomers is not particularly limited.

The content of the monomer 1 is not particularly limited, when the object of the present invention is achieved, and it is, for example, 30 to 99.9 wt %, preferably 40 to 99.8 wt %, more preferably 45 to 99.7 wt %, with respect to the total amount of the undercoat composition for forming a metal film. When two or more monomers 1 are used, the total content thereof is in the range above.

The polymerization initiator is not particularly limited, when it can polymerize the monomer 1, and examples thereof include radical polymerization initiators such as photopolymerization initiator and thermal polymerization initiator; ionic polymerization initiators such as cationic polymerization initiator and anionic polymerization initiator; and the like. A radical polymerization initiator, in particular a photopolymerization initiator, is used favorably.

Examples of the photopolymerization initiators include 2-hydroxy-2-methyl-1-phenyl-propen-1-one, 2-methyl-1-[4-(methylthio) phenyl]-2-morpholinopropen-1-one, 2,4,6-trimethylbenzoyl-diphenyl-phosphine oxide, triphenylsulfonium triflate, and the like.

Examples of the thermal polymerization initiators include cumene hydroperoxide, t-butyl hydroperoxide, benzoyl peroxide, DBU, ethylenediamine, N,N-dimethylbenzylamine, and the like.

The content of the polymerization initiator is normally 0.1 to 10 wt %, preferably 0.2 to 8 wt %, more preferably 0.3 to 6 wt %, with respect to the total amount of the undercoat composition for forming a metal film.

A crosslinking agent and/or a surfactant are preferably added to the undercoat composition for forming a metal film, for making the ion in film reduced more easily by addition of a bulky structure.

The crosslinking agent may be any compound, if it does not have an acidic group or the ester thereof such as that of the monomer 1, but has polymerizable unsaturated bonds, preferably two or more polymerizable unsaturated bonds, in particular 3 to 4 polymerizable unsaturated bonds, in one molecule.

Examples of the crosslinking agents for use include trimethylolpropane tri(meth)acrylate, pentaerythritol tetra(meth) acrylate, diethylene glycol di(meth)acrylate, dipentaerythritol hexa(meth)acrylate, and the like.

The content of the crosslinking agent is normally 0 to 69.9 wt %, preferably 5 to 50 wt %, more preferably 10 to 45 wt %, with respect to the total amount of the undercoat composition for forming a metal film.

Examples of the surfactants include polyether-modified silicones (e.g., KF351 (manufactured by Shin-Etsu Chemical Co., Ltd.)), fluorine-modified silicones (e.g., FL-5 (manufactured by Shin-Etsu Chemical Co., Ltd.)), alcohol-modified silicones (e.g., KF6001 (manufactured by Shin-Etsu Chemical Co., Ltd.)), alkyl-modified silicones (e.g., KF96-6cs (manufactured by Shin-Etsu Chemical Co., Ltd.)), and the like.

The content of the surfactant is normally 0 to 69.9 wt %, preferably 0.01 to 50 wt %, more preferably 0.1 to 10 wt %, with respect to the total amount of the undercoat composition for forming a metal film.

The undercoat composition for forming a metal film may contain an addition-polymerizable monomer (hereinafter, referred to simply as "monomer 2") additionally to the monomer 1 and the crosslinking agent. The monomer 2 is a compound having no acidic group or no ester thereof such as that in the monomer 1 but having polymerizable unsaturated bonds, particularly one polymerizable double bond, in one molecule.

Examples of the monomer 2 for use include styrene, vinylcyclohexane, and the like.

The content of the monomer 2 is preferably 50 wt % or less, particularly preferably 30 wt % or less, with respect to the total amount of the undercoat composition for forming a metal film.

The undercoat composition for forming a metal film may contain an organic solvent additionally. Presence of the organic solvent improves coating properties of the mixture. Examples of the organic solvents for use include propylene glycol monomethylether acetate, propylene glycol monomethylether, cyclohexanone, butyl acetate, and the like.

The content of the organic solvent is preferably 80 wt % or less, particularly preferably 30 wt % or less, with respect to the total amount of the undercoat composition for forming a metal film.

Any material may be used as a substrate or film, because the material can be processed at relatively low temperature in the present invention. Typical examples thereof include acrylic resins, polycarbonate resins, polyethylene terephthalate, epoxy resins, glass, quartz, lithium niobate, lithium tantalate, borosilicate glass, silicaborate glass, PZT, PLZT, and the like.

Any application method may be used in applying the undercoat composition for forming a metal film on a substrate or film, and examples thereof include spin coating, spray coating, and dip coating. The coating thickness is not particularly limited, but, for example, the thickness of the organic film after polymerization is preferably in the range described below.

A known method of polymerization is used as selected properly according to the kind of the polymerization initiator.

For example, when a photopolymerization initiator is used, a light at a wavelength making the photopolymerization initiator generate radicals by absorption of the light, for example ultraviolet ray, is preferably irradiated from the coated-surface side of the substrate or film.

Alternatively when a thermal polymerization initiator is used, the mixture is heated to a temperature at which the thermal polymerization initiator decomposes, generating radical, for example to 50 to 150° C.

It is possible to form an organic film having a pattern shape corresponding to a mask, by performing polymerization by ultraviolet irradiation through a mask and removing the unreacted monomer region in the polymerization. It is thus possible to form a metal film having a pattern shape by processing the obtained organic film in the step described below. The unreacted monomer region is removed with hydrochloric acid, nitric acid, or sulfuric acid.

The thickness of the organic film obtained after polymerization is not particularly limited, when the object of the present invention is achieved, but preferably, for example, 0.1 to 1000 μm, particularly preferably 10 to 500 μm.

Step (B);

In the step (B), the acidic group or the ester group thereof in the organic film obtained in the step (A) is converted to a metal (M1) salt of the acidic group. The processing method may vary according to the group in the organic film. In description of the following step (B), the case where the group of the organic group is an acidic group (step (b1)) and the case where it is the ester of the acidic group (step (b2)) will be described separately.

Step (b1);

When an acidic group-containing organic film is prepared with an acidic group-containing monomer 1 in the step (A), the acidic group on the organic film is converted to a metal (M1) salt by treatment with an aqueous solution containing the metal (M1) ion. The treatment is performed easily, for example, by immersing the substrate or film carrying the organic film in the aqueous solution containing the metal (M1) ion.

The metal (M1) ion is a metal ion cation-exchangeable with metal (M2) ion for forming a metal film in the step (C) described below, and thus, is cation-exchangeable with the metal (M2) ion in the step (C). Specifically, the metal (M1) ion has an ionization tendency higher than that of the metal (M2) ion. Thus, the metal (M1) ion is selected properly according to the metal (M2) ion. The metal (M1) ion is normally selected from potassium and sodium ions. In the present description, the ionization tendency is a tendency of a metal in contact with water to ionize into the metal ion (cation), and the value of the ionization tendency of a metal ion is based on the tendency of the metal to ionize into the metal ion.

For example when a silver ion is used as the metal (M2) ion in the step (C) below, the metal (M1) ion is normally, preferably selected from potassium and sodium ions.

Alternatively, for example when a copper ion is used as the metal (M2) ion in the step (C) below, the metal (M1) ion is normally, preferably selected from potassium and sodium ions.

Yet alternatively, for example when a gold ion is used as the metal (M2) ion in the step (C) below, the metal (M1) ion is normally, preferably selected from potassium and sodium ions.

Yet alternatively, for example when a palladium ion is used as the metal (M2) ion in the step (C) below, the metal (M1) ion is normally, preferably selected from potassium and sodium ions.

Yet alternatively, for example when an indium ion is used as the metal (M2) ion in the step (C) below, the metal (M1) ion is normally, preferably selected from potassium and sodium ions.

Yet alternatively, for example when a platinum ion is used as the metal (M2) ion in the step (C) below, the metal (M1) ion is normally, preferably selected from potassium and sodium ions.

Typical examples of the aqueous solution containing the metal (M1) ion include aqueous solutions containing potassium hydroxide, sodium hydroxide, or the like. The concentration of the metal (M1) ion in such an aqueous solution is not particularly limited, when the metal salt of the acidic group is formed, but, a relatively low concentration range of 0.1 to 2.5 M is effective in generating the metal salt of the acidic group and is thus favorable in the present invention. Two or more metal (M1) ions may be used in the present invention, and, in such a case, the total concentration of the metal (M1) ions is in the range above.

The hydrogen ion of the acidic group on the organic film is substituted with the metal (M1) ion by treatment with a metal (M1) ion-containing aqueous solution. Specifically, the hydrogen ion of the acidic group such as —COOH or —$SO_3H$ on the organic film is substituted directly with the metal (M1) ion, forming an acidic group metal salt such as —$COOM^1$ or —$SO_3M^1$. $M^1$ represents the metal atom of the metal (M1) ion (hereinafter, the same below).

The processing condition in the step (b1) is not particularly limited, when the acidic group metal salt is generated, and the processing temperature is normally 0 to 80° C., preferably 20 to 40° C. The processing period (immersion period) is normally 1 to 30 minutes, preferably 5 to 15 minutes.

Step (b2);

When a monomer 1 having the ester group of the acidic group is used in the step (A) and the organic film has the ester group, the ester group of the acidic group is converted to the metal (M1) salt of the acidic group, by the following treatment (b2-1) or (b2-2).

The organic film is treated with an aqueous alkaline solution containing an alkali metal ion by the treatment (b2-1). The method of the treatment (b2-1) is the same as that in the step (b1), except that among the aqueous solutions containing a metal (M1) ion, an aqueous alkaline solution containing an alkali metal ion such as potassium or sodium ion is used.

The ester bond in the ester group of the acidic group on the organic film is hydrolyzed by the treatment (b2-1). Specifically, the ester group on the organic film such as —$COOR^5$ or —$SO_3R^5$ is hydrolyzed to give an alkali-metal salt of the acidic group such as —COOK, —COONa, —$SO_3K$ or —$SO_3Na$.

In the treatment (b2-2), the organic film is treated with an aqueous acid solution and then with an aqueous solution containing the metal (M1) ion. The ester bond in the ester group of the acidic group on the organic film is hydrolyzed to give an acidic group by the treatment with an aqueous acid solution, and the hydrogen ion of the acidic group is substituted with the metal (M1) ion by the subsequent treatment with an aqueous solution containing the metal (M1) ion. Specifically, the ester group on the organic film such as —$COOR^5$ or —$SO_3R^5$ is hydrolyzed by the aqueous acid solution treatment, to give an acidic group such as —COOH or —$SO_3H$. Then, by treatment with an aqueous solution containing the metal (M1) ion, the hydrogen ion of the acidic group is substituted with a metal (M1) ion, to give an acidic group metal salt such as —$COOM^1$ or —$SO_3M^1$.

The treatment with an aqueous acid solution is performed easily, for example, by immersing the substrate or film carrying the organic film in an aqueous acid solution. An aqueous solution containing, for example, hydrochloric acid, sulfuric acid, nitric acid or acetic acid, can be used as the aqueous acid solution. The concentration of the acid is, for example, 0.1 to 10 M, preferably 0.5 to 5 M. The processing temperature is, for example, 0 to 80° C., preferably 20 to 50° C. The processing period (immersion period) is, for example, 1 to 30 minutes, preferably 5 to 15 minutes.

The method of processing with an aqueous solution containing the metal (M1) ion in the treatment (b2-2) is the same as that in the step (b1), and the processing temperature is 0 to 80° C., preferably 20 to 50° C.

Step (C);

In the step (C), the organic film obtained in the step (B) is treated with an aqueous solution containing a metal ion (metal (M2) ion) for preparation of metal film, to convert the acidic group metal (M1) salt into the metal (M2) salt. In particular, when the organic film has an alkali-metal salt of acidic group by the treatment (b2-1) in the step (B), the alkali-metal salt is converted to the metal (M2) salt by the treatment. The treatment is performed easily, for example, by immersing the substrate or film carrying the organic film in an aqueous solution containing a metal (M2) ion. As described above, because the metal (M2) ion has an ionization tendency lower than that of the metal (M1) ion or the alkali metal ion, the metal (M1) salt or alkali-metal salt of the acidic group on the organic film is converted for example, from —$COOM^1$ or —$SO_3M^1$ to —$COOM^2$ or —$SO_3M2$ easily by such treatment, allowing introduction and immobilization of the metal (M2) ion on the organic film by cation exchange. M2 represents the metal atom of the metal (M2) ion (hereinafter, the same below).

The metal (M2) ion is the ion of the metal for a particular metal film to be formed, and as described above, has an ionization tendency lower than that of the metal (M1) ion. In particular, when the treatment (b2-1) is carried out in the step (B), the metal (M2) ion has ionization tendency low than that of the alkali metal ion.

The metal (M2) ion is, normally, an ion selected from silver, copper, gold, palladium, indium, platinum, cobalt, and nickel.

Typical examples of the aqueous solution containing a metal (M2) ion include aqueous solutions of silver nitrate, silver acetate, silver carbonate, silver sulfate, silver chloride, copper nitrate, copper sulfate, copper acetate, copper carbonate, copper chloride, gold (I) chloride, gold (III) chloride, a chloroaurate salt, gold acetate, palladium chloride, indium sulfate, trans-diamine dichloroplatinum, or the like. The concentration of the metal (M2) ion in such an aqueous solution is not particularly limited, when the cation exchange occurs, but preferably 1 to 500 mM, particularly preferably 50 to 200 mM. The processing temperature is, for example, 0 to 80° C., preferably 20 to 40° C. The processing period (immersion period) is, for example, 1 to 30 minutes, preferably 5 to 15 minutes. Two or more metal (M2) ions may be used in the present invention, and, in such a case, the total concentration of the metal (M2) ions is in the range above.

Step (D);

In the step (D), the metal ion (metal (M2) ion) for preparation of metal film is reduced, to form a metal film on the surface of the organic film. Thus, the metal atom of the ion is allowed to deposit on the organic film surface by reduction of the metal (M2) ion introduced on the organic film in the step (C), to give a particular metal film.

The reduction method is not particularly limited, when the metal ion is reduced, and examples thereof include methods of using a reducing agent such as sodium borohydride, dimethylamine borane, trimethylamine borane, hydrazine, formaldehyde, or the derivative thereof, sulfite salt, or hypophosphite salt, methods of irradiation by ultraviolet ray, methods of using plasma, methods of using hydrogen, the like.

For example in the method of using the reducing agent, the organic film surface is brought into contact with the reducing agent. The reducing agent is normally used in the form of an aqueous solution, and the substrate or film carrying an organic film is reduced easily when it is immersed in the aqueous reducing agent solution. The concentration of the reducing agent in the aqueous reducing agent solution is preferably 1 to 500 mM, particularly preferably 5 to 50 mM. The processing temperature is, for example, 0 to 80° C., preferably 20 to 40° C. The processing period (immersion period) is, for example, 1 to 30 minutes, preferably 5 to 15 minutes.

For example in the method of irradiation by ultraviolet ray, the surface of the organic film is irradiated with ultraviolet ray. For example when a UV-irradiating apparatus PL16-110 manufactured by SEN Lights Corporation is used, the exposure period is preferably 10 to 150 minutes, particularly preferably 60 to 90 minutes. It is possible to form a metal film in a pattern shape corresponding to a mask by ultraviolet ray irradiation by using a mask during reduction in such a method. It is possible to form even a relatively complicated metal pattern easily by performing reduction by ultraviolet ray irradiation with a mask. The region other than the patterned area is removed, for example, by immersion in approximately 1% aqueous nitric or sulfuric acid solution.

The substrate or film after completion of reduction is usually cleaned and dried.

It may be cleaned by washing with water, but is preferably washed with aqueous sulfuric acid solution.

The substrate or film may be dried as left at normal temperature, but is preferably dried under nitrogen atmosphere for prevention of oxidation of the metal film obtained.

The substrate or film is preferably washed with water between respective steps or treatments in the present invention as a washing process.

The thickness of the metal film thus obtained in the steps above is not particularly limited, but is controlled, for example, in the range of 10 to 500 nm, particularly preferably in the range of 20 to 200 nm.

The thickness of the metal film can be determined by observation of the cross section, for example, by means of TEM (manufactured by Hitachi High-Technologies Corp.).

EXAMPLES

The following materials were used:

TMP-A (Kyoeisha Chemical Co., Ltd., trimethyloipropane triacrylate)

PE-4A (Kyoeisha Chemical Co., Ltd., pentaerythritol tetraacrylate)

TBA (Osaka Organic Chemical Industry Ltd., tributyl acrylate)

Example 1

The following compounds were mixed, to give a chemical solution.

Darocure 1173 0.30% (Ciba Specialty Chemicals K.K.)

Acrylic acid 99.7% (Wako Pure Chemical Industries, Ltd.)

The chemical solution was applied on an acrylic plate by spin coating and UV-irradiated in a UV-irradiating apparatus PL16-110 manufactured by SEN Lights Corporation for 6 minute, to give a transparent undercoat film (resin film) (thickness: approximately 20 μm) on the acrylic plate.

Then, the acrylic plate carrying the undercoat film was processed in the following steps to give an Ag film.

(1) Immersion in 2.5 M aqueous potassium hydroxide solution at 25° C. for 10 minutes
(2) Thorough washing in distilled water
(3) Immersion in 50 mM aqueous silver nitrate solution at normal temperature for 10 minutes
(4) Thorough washing in distilled water
(5) Immersion in 50 mM aqueous sodium borohydride solution at normal temperature for 5 minutes
(6) Thorough washing in distilled water
(7) Washing in 1% sulfuric acid at normal temperature
(8) Thorough washing in distilled water
(9) Drying under nitrogen atmosphere In this way, obtained was an Ag film with dark blue metallic glossiness, having a thickness of approximately 20 nm. It was thus possible to form a metal film having a thickness of several dozen nm cost-effectively on a substrate commonly used in the industry (acrylic plate) without use of expensive equipment. Because the method demands a maximum temperature of only 45° C., which is significantly lower than that in the traditional technology, in the entire metal film-forming step, there is no restriction on the kind of the substrate and it is possible to form a metal film on a material lower in heat resistance, such as acrylic resin. The film thickness is not particularly limited.

Example 2

The following compounds were mixed, to give a chemical solution.

Darocure 1173 0.30% (Ciba Specialty Chemicals K.K.)

Acrylic acid 89.7% (Wako Pure Chemical Industries, Ltd.)

TMP-A 5.0% (Kyoeisha Chemical Co., Ltd.)

PE-4A 5.0% (Kyoeisha Chemical Co., Ltd.)

The chemical solution was applied on an acrylic plate by spin coating and UV-irradiated in a UV-irradiating apparatus PL16-110 manufactured by SEN Lights Corporation for 6 minute, to give a transparent undercoat film (resin film) (thickness: approximately 20 μm) on the acrylic plate.

Then, the acrylic plate carrying the undercoat film was processed in the following steps to give an Ag film.

(1) Immersion in 2.5 M aqueous potassium hydroxide solution at 25° C. for 10 minutes
(2) Thorough washing in distilled water
(3) Immersion in 50 mM aqueous silver nitrate solution at normal temperature for 10 minutes
(4) Thorough washing in distilled water
(5) Immersion in 50 mM aqueous sodium borohydride solution at normal temperature for 5 minutes
(6) Thorough washing in distilled water
(7) Washing in 1% sulfuric acid at normal temperature
(8) Thorough washing in distilled water
(9) Drying under nitrogen atmosphere As the resin structure was bulkier than that of Example 1, the Ag film thus prepared increased in the amount of the metal ion to be reduced and an Ag film showing mirror reflection was given on the rear face without blackness of the rear face. In addition, increase in the amount of the reduced ion is accompanied with increase in the thickness of the metal film (50 nm) synergistically, giving a silver-colored metal face. The selectivity of the substrate is the same as that in Example 1. The film thickness is not particularly limited.

Example 3

The following compounds were mixed, to give a chemical solution.

Darocure 1173 0.30% (Ciba Specialty Chemicals K.K.)

Acrylic acid 89.7% (Wako Pure Chemical Industries, Ltd.)

TMP-A 5.0% (Kyoeisha Chemical Co., Ltd.)

PE-4A 5.0% (Kyoeisha Chemical Co., Ltd.)

The chemical solution was applied on an acrylic plate by spin coating and UV-irradiated in a UV-irradiating apparatus PL16-110 manufactured by SEN Lights Corporation for 6 minute, to give a transparent undercoat film (resin film) (thickness: approximately 20 μm) on the acrylic plate.

Then, the acrylic plate carrying the undercoat film was processed in the following steps to give a conductive Ag film.

(1) Immersion in 2.5 M aqueous potassium hydroxide solution at 25° C. for 10 minutes
(2) Thorough washing in distilled water
(3) Immersion in 50 mM aqueous silver nitrate solution at normal temperature for 10 minutes
(4) Thorough washing in distilled water
(5) UV irradiation for 60 minutes (UV-irradiating apparatus PL16-110, manufactured by SEN Lights Corporation)
(6) Thorough washing in distilled water
(7) Washing in 1% sulfuric acid at normal temperature
(8) Thorough washing in distilled water
(9) Drying under nitrogen atmosphere In this way obtained was an Ag film having a thickness of 50 nm. As the resin structure was bulkier than that of Example 1, the amount of the Ag ion to be UV-reduced increased, and thus, an Ag film showing mirror reflection on the surface was given. The selectivity of the substrate is the same as that in Example 1. An effect similar to that in Example 2 was also obtained by UV reduction. The film thickness is not particularly limited.

Example 4

The following compounds were mixed, to give a chemical solution.

Darocure 1173 0.30% (Ciba Specialty Chemicals K.K.)

Acrylic acid 89.7% (Wako Pure Chemical Industries, Ltd.)

TMP-A 5.0% (Kyoeisha Chemical Co., Ltd.)

PE-4A 5.0% (Kyoeisha Chemical Co., Ltd.)

The chemical solution was applied on an acrylic plate by spin coating and UV-irradiated in a UV-irradiating apparatus PL16-110 manufactured by SEN Lights Corporation for 6 minute, to give a transparent undercoat film (resin film) (thickness: approximately 20 μm) on the acrylic plate.

Then, acrylic plate carrying the undercoat film was processed in the following steps, to give a 1:1 Line & Space Ag pattern having a minimum line width of 2 μm.

(1) Immersion in 2.5 M aqueous potassium hydroxide solution at 25° C. for 10 minutes (2) Thorough washing in distilled water
(3) Immersion in 50 mM aqueous silver nitrate solution at normal temperature for 10 minutes
(4) Thorough washing in distilled water
(5) Placement of a water droplet on the substrate and a mask thereon without incorporation of air bubble, and subsequent UV irradiation for 60 minutes (UV-irradiating apparatus PL16-110, manufactured by SEN Lights Corporation)
(6) Thorough washing in distilled water
(7) Washing in 1% sulfuric acid at normal temperature
(8) Thorough washing in distilled water
(9) Drying under nitrogen atmosphere The UV irradiation via a mask gave an Ag pattern, a 1:1 L&S Ag pattern having a minimum line width of 2 μm. The transparency exerts a significant influence on the resolution from the point of contrast, and the present invention is improved in transparency compared to that of a conventional technique, resulting in much more improvement in resolution than that of the conventional technique. The substrate for use is hardly restricted, and such a pattern may be formed on any cheap and transparent material such as acrylic resin. The selectivity of the substrate is the same as that in Example 1. The film thickness is not particularly limited, and the minimum line width depends on the performance of the UV-irradiating apparatus.

Example 5

The following compounds were mixed, to give a chemical solution.

Darocure 1173 0.30% (Ciba Specialty Chemicals K.K.)
Acrylic acid 89.7% (Wako Pure Chemical Industries, Ltd.)
TMP-A 5.0% (Kyoeisha Chemical Co., Ltd.)
PE-4A 5.0% (Kyoeisha Chemical Co., Ltd.)

The chemical solution was applied on an acrylic plate by spin coating and UV-irradiated in a UV-irradiating apparatus PL16-110 manufactured by SEN Lights Corporation for 6 minute, to give a transparent undercoat film (resin film) (thickness: approximately 20 μm) on the acrylic plate.

Then, the acrylic plate carrying the undercoat film was processed in the following steps to give a conductive. Cu film.
(1) Immersion in 2.5 M aqueous potassium hydroxide solution at 25° C. for 10 minutes
(2) Thorough washing in distilled water
(3) Immersion in 50 mM aqueous copper sulfate solution at normal temperature for 10 minutes
(4) Thorough washing in distilled water
(5) UV irradiation for 60 minutes (UV-irradiating apparatus PL16-110, manufactured by SEN Lights Corporation)
(6) Thorough washing in distilled water
(7) Washing in 1% sulfuric acid at normal temperature
(8) Thorough washing in distilled water
(9) Drying under nitrogen atmosphere The Cu film thus prepared was a Cu film having a thickness of approximately 60 nm. It was thus possible to form a metal film having a thickness of several dozen nm cost-effectively on a substrate commonly used in the industry (acrylic plate) without use of expensive equipment. Because the method demands a maximum temperature of only 25° C., which is significantly lower than that by the conventional technology, in the entire metal film-forming step, there is no restriction on the substrate, and it is possible to form a metal film on a material lower in heat resistance, such as acrylic resin. The film thickness is not particularly limited.

Example 6

The following compounds were mixed, to give a chemical solution.

Darocure 1173 5.0% (Ciba Specialty Chemicals K.K.)
TBA 95.0% (Osaka Organic Chemical Industry Ltd.)

Application of the chemical solution on an acrylic plate by spin coating and subsequent UV irradiation in an UV-irradiating apparatus PL16-110 manufactured by SEN Lights Corporation for 10 minutes gave a transparent undercoat film (resin film) (thickness: approximately 20 μm) on the acrylic plate.

Then, the acrylic plate carrying the undercoat film was processed in the following steps to give an Ag film.
(1) Immersion in 2.5 M aqueous potassium hydroxide solution at 30° C. for 10 minutes
(2) Thorough washing in distilled water
(3) Immersion in 50 mM aqueous silver nitrate solution at normal temperature for 10 minutes
(4) Thorough washing in distilled water
(5) Immersion in 100 mM aqueous sodium borohydride solution at normal temperature for 5 minutes
(6) Thorough washing in distilled water
(7) Washing in 1% sulfuric acid at normal temperature
(8) Thorough washing in distilled water
(9) Drying under nitrogen atmosphere In this way, obtained was an Ag film having a thickness of approximately 30 nm. It was possible, without use of a crosslinking agent, to obtain an effect similar to that with a crosslinking agent added, by hydrolyzing (saponifying) the bulky ester with an alkali (when the ester is saponified similarly to Example 2).

Example 7

The following compounds were mixed, to give a chemical solution.

Darocure 1173 5.0% (Ciba Specialty Chemicals K.K.)
TBA 75.0% (Osaka Organic Chemical Industry Ltd.)
PE-4A 20.0% (Kyoeisha Chemical Co., Ltd.)

Application of the chemical solution on an acrylic plate by spin coating and subsequent UV irradiation in an UV-irradiating apparatus PL16-110 manufactured by SEN Lights Corporation for 10 minutes gave a transparent undercoat film (resin film) (thickness: approximately 30 μm) on the acrylic plate.

Then, the acrylic plate carrying the undercoat film was processed in the following steps to give an Ag film.
(1) Immersion in 1 M aqueous HCl solution at 30° C. for 10 minutes
(2) Thorough washing in distilled water
(3) Immersion in 2.5 M aqueous potassium hydroxide solution at normal temperature for 10 minutes
(4) Thorough washing in distilled water
(5) Immersion in 50 mM aqueous silver nitrate solution at normal temperature for 10 minutes
(6) Thorough washing in distilled water
(7) Immersion in 100 mM aqueous sodium borohydride solution at normal temperature for 5 minutes
(8) Thorough washing in distilled water
(9) Washing in 1% sulfuric acid at normal temperature
(10) Thorough washing in distilled water
(11) Drying under nitrogen atmosphere In this way obtained was an Ag film having a thickness of approximately 50 nm. An effect similar to that in Example 6 was obtained by hydrolysis of the ester with an acid.

Example 8

The following compounds were mixed, to give a chemical solution.

Darocure 1173 5.0% (Ciba Specialty Chemicals K.K.)
TBA 75.0% (Osaka Organic Chemical Industry Ltd.)
PE-4A 20.0% (Kyoeisha Chemical Co., Ltd.)

Application of the chemical solution on an acrylic plate by spin coating and subsequent UV irradiation in an UV-irradiating apparatus PL16-110 manufactured by SEN Lights Corporation for 10 minutes gave a transparent undercoat film (resin film) (thickness: approximately 20 μm) on the acrylic plate.

Then, the acrylic plate carrying the undercoat film was processed in the following steps, to give an 1:1 L&S Ag pattern having a minimum line width of 2 μm.

(1) Immersion in 2.5 M aqueous potassium hydroxide solution at 30° C. for 10 minutes
(2) Thorough washing in distilled water
(3) Immersion in 50 mM aqueous silver nitrate solution at normal temperature for 10 minutes
(4) Thorough washing in distilled water
(5) Placement of a water droplet on the substrate and a mask thereon without incorporation of air bubble, and subsequent UV irradiation for 60 minutes (UV-irradiating apparatus PL16-110, manufactured by SEN Lights Corporation)
(6) Thorough washing in distilled water
(7) Washing in 1% sulfuric acid at normal temperature
(8) Thorough washing in distilled water
(9) Drying under nitrogen atmosphere In this way obtained was an Ag film having thickness of approximately 40 nm. It was possible to form a fine metal wiring, similarly to Example 4, even by the method of using saponification of an ester-type resin.

Similar results were obtained, even when Darocure 1173 Examples 1 to 8 was replaced with Irgacure 651 or 907, or Lucirin TPO manufactured by BASF Japan, Ltd.

Similar results were obtained, even when silver nitrate was replaced with silver acetate, silver carbonate, or silver sulfate (all manufactured by Wako Pure Chemical Industries, Ltd) at the same concentration.

The particular metal film was obtained, even when silver nitrate was replaced with palladium chloride, indium sulfate, or trans-diamine dichloroplatinum at the same concentration.

Comparative Example 1

A polyimide plate (Kapton 200H; Du Pont-Toray Co., Ltd.) was processed in the following steps:

(1) Immersion in 5 M aqueous potassium hydroxide solution at 50° C. for 5 minutes
(2) Thorough washing in distilled water
(3) Immersion in 50 mM aqueous silver nitrate solution at normal temperature for 5 minutes
(4) Thorough washing in distilled water
(5) Placement of a water droplet on the substrate and a Cr-coated quartz mask thereon without incorporation of air bubble, and subsequent UV irradiation for 60 minutes (UV-irradiating apparatus PL16-110, manufactured by SEN Lights Corporation)
(6) Thorough washing in distilled water
(7) Washing in 1% sulfuric acid at normal temperature
(8) Thorough washing in distilled water
(9) Drying under nitrogen atmosphere In the present step, it was not possible to form a 1:1 L&S pattern having a minimum line width of 2 μm, although the reduction treatment was performed under the UV irradiation condition same as that in Examples 4 and 8.

INDUSTRIAL APPLICABILITY

The present invention is useful in forming a metal film for use as electrode, fine wiring circuit, reaction film, protective film, or the like in applications such as various electronic parts and sensors, for example, semiconductor, liquid crystal display panel, high-frequency devices etc. It is also possible to form a metal film for a SPR or SAW sensor, according to the present invention.

What is claimed is:

1. A method of forming a metal film, comprising:

a step of forming an organic film by applying and polymerizing an undercoat composition for forming a metal film containing an addition-polymerizable monomer 1 having a carboxylic acid group or a sulfonic acid group, a monomer not having a carboxylic acid group or a sulfonic acid group contained in the addition-polymerizable monomer 1 but having 3 to 4 polymerizable unsaturated bonds in one molecule and a polymerization initiator on a substrate or film;

a step of converting the carboxylic acid group or the sulfonic acid group acidic group into a metal (M1) salt by treating the organic film with an aqueous solution containing a metal (M1) ion;

a step of converting the metal (M1) salt into a metal (M2) salt by treating the organic film with an aqueous solution containing a metal (M2) ion having an ionization tendency lower than the metal (M1) ion; and a step of forming a metal film on the organic film surface by reducing the metal (M2) ion.

2. The method of forming a metal film according to claim 1, wherein the undercoat composition for forming the metal film further comprises a surfactant.

3. The method of forming a metal film according to claim 2, wherein in the undercoat composition for forming the metal film, the content of the polymerizable monomer 1 is 30 to 99.9 wt % with respect to the total amount of the composition, the content of the monomer having 3 to 4 polymerizable unsaturated bonds in one molecule is 5 to 50 wt % with respect to the total amount of the composition, and the content of the polymerization initiator is 0.1 to 10 wt %.

4. The method of forming a metal film according to claim 1, wherein the coating is performed by spin coating or spray coating and the polymerization by irradiation of ultraviolet ray.

5. The method of forming a metal film according to claim 1, wherein the aqueous solution containing the metal (M1) ion used is an aqueous solution of potassium hydroxide or sodium hydroxide.

6. The method of forming a metal film according to claim 1, wherein the metal (M2) ion is one selected from the group consisting of a silver ion, a copper ion, a gold ion, a palladium ion, an indium ion and a platinum ion.

7. The method of forming a metal film according to claim 1, wherein the reduction is performed by using one selected from the group consisting of sodium borohydride, dimethylamine borane, trimethylamine borane, hydrazine, formaldehyde, a derivative thereof, a sulfite salt, a hypophosphite salt, ultraviolet ray, plasma, and hydrogen.

8. The method of forming a metal film according to claim 1, wherein in the step of forming an organic film, the polymerization is carried out by irradiation of ultraviolet ray by using a mask and unreacted monomers are removed.

9. A method of forming a metal film, comprising:

a step of forming an organic film by applying and polymerizing an undercoat composition for forming a metal film containing an addition-polymerizable monomer 1 having an ester group of a carboxylic acid group or a sulfonic acid group, a monomer not having a carboxylic acid group or a sulfonic acid group contained in the addition-polymerizable monomer 1 but having 3 to 4 polymerizable unsaturated bonds in one molecule and a polymerization initiator on a substrate or film;

a step of converting the ester group of the carboxylic acid group or sulfonic acid group into an alkali-metal salt of the carboxylic acid group or sulfonic acid group by treating the organic film with an aqueous solution containing a metal (M1) ion;

a step of converting the alkali-metal salt of the carboxylic acid group or sulfonic acid group into a metal (M2) salt by treating the organic film with an aqueous solution containing a metal (M2) ion having an ionization tendency lower than that of the alkali metal ion; and a step of forming a metal film on the organic film surface by reducing the metal (M2) ion.

10. The method of forming a metal film according to claim 9, wherein the undercoat composition for forming the metal film further comprises a surfactant.

11. The method of forming a metal film according to claim 10, wherein in the undercoat composition for forming the metal film, the content of the polymerizable monomer 1 is 30 to 99.9 wt % with respect to the total amount of the composition, the content of the monomer having 3 to 4 polymerizable unsaturated bonds in one molecule is 5 to 50 wt % with respect to the total amount of the composition and the content of the polymerization initiator is 0.1 to 10 wt %.

12. The method of forming a metal film according to claim 9, wherein the coating is performed by spin coating or spray coating and the polymerization by irradiation of ultraviolet ray.

13. The method of forming a metal film according to claim 9, wherein the aqueous solution containing the metal (M1) ion used is an aqueous solution of potassium hydroxide or sodium hydroxide.

14. The method of forming a metal film according to claim 9, wherein the metal (M2) ion is one selected from the group consisting of a silver ion, a copper ion, a gold ion, a palladium ion, an indium ion and a platinum ion.

15. The method of forming a metal film according to claim 9, wherein the reduction is performed by using one selected from the group consisting of sodium borohydride, dimethylamine borane, trimethylamine borane, hydrazine, formaldehyde, a derivative thereof, a sulfite salt, a hypophosphite salt, ultraviolet ray, plasma, and hydrogen.

16. The method of forming a metal film according to claim 9, wherein in the step of forming an organic film, the polymerization is carried out by irradiation of ultraviolet ray by using a mask and unreacted monomers are removed.

17. A method of forming a metal film, comprising:

a step of forming an organic film by applying and polymerizing an undercoat composition for forming a metal film containing an addition-polymerizable monomer 1 having an ester group of a carboxylic acid group or a sulfonic acid group, a monomer not having a carboxylic acid group or a sulfonic acid group contained in the addition-polymerizable monomer 1 but having 3 to 4 polymerizable unsaturated bonds in one molecule and a polymerization initiator on a substrate or film;

a step of converting the ester group of the carboxylic acid group or the sulfonic acid group into a metal (M1) salt of the carboxylic acid group or the sulfonic acid group by treating the organic film with an aqueous acid solution and then with an aqueous solution containing a metal (M1) ion;

a step of converting the metal (M1) salt into a metal (M2) salt by treating the organic film with an aqueous solution containing a metal (M2) ion having an ionization tendency lower than the metal (M1) ion; and a step of forming a metal film on the organic film surface by reducing the metal (M2) ion.

18. The method of forming a metal film according to claim 17, wherein the undercoat composition for forming the metal film further comprises a surfactant.

19. The method of forming a metal film according to claim 18, wherein in the undercoat composition for forming the metal film, the content of the polymerizable monomer 1 is 30 to 99.9 wt % with respect to the total amount of the composition, the content of the monomer having 3 to 4 polymerizable unsaturated bonds in one molecule is 5 to 50 wt % with respect to the total amount of the composition and the content of the polymerization initiator is 0.1 to 10 wt %.

20. The method of forming a metal film according to claim 17, wherein the coating is performed by spin coating or spray coating and the polymerization by irradiation of ultraviolet ray.

21. The method of forming a metal film according to claim 17, wherein the aqueous solution containing the metal (M1) ion used is an aqueous solution of potassium hydroxide or sodium hydroxide.

22. The method of forming a metal film according to claim 17, wherein the metal (M2) ion is one selected from the group consisting of a silver ion, a copper ion, a gold ion, a palladium ion, an indium ion and a platinum ion.

23. The method of forming a metal film according to claim 17, wherein the reduction is performed by using one selected from the group consisting of sodium borohydride, dimethylamine borane, trimethylamine borane, hydrazine, formaldehyde, a derivative thereof, a sulfite salt, a hypophosphite salt, ultraviolet ray, plasma, and hydrogen.

24. The method of forming a metal film according to claim 17, wherein the aqueous acid solution used is an aqueous solution of hydrochloric acid, sulfuric acid, nitric acid or acetic acid.

25. The method of forming a metal film according to claim 17, wherein in the step of forming an organic film, the polymerization is carried out by irradiation of ultraviolet ray by using a mask and unreacted monomers are removed.

26. The method of forming a metal film according to claim 1, wherein in the step of forming a metal film, the reduction is carried out by irradiation of ultraviolet ray by using a mask to give a metal film having a pattern shape.

27. The method of forming a metal film according to claim 9, wherein in the step of forming a metal film, the reduction is carried out by irradiation of ultraviolet ray by using a mask to give a metal film having a pattern shape.

28. The method of forming a metal film according to claim 17, wherein in the step of forming a metal film, the reduction is carried out by irradiation of ultraviolet ray by using a mask to give a metal film having a pattern shape.

* * * * *